US006089830A

United States Patent [19]

Harte et al.

[11] Patent Number: 6,089,830

[45] Date of Patent: Jul. 18, 2000

[54] MULTI-STAGE COMPRESSOR WITH CONTINUOUS CAPACITY CONTROL

[75] Inventors: Shane Anthony Harte, Dearborn; Lavlesh Sud, Farmington Hills; Ronald J. Mangiapane, Dearborn; Guntis Viktors Strikis, Belleville, all of Mich.

[73] Assignee: Ford Global Technologies, Inc., Dearborn, Mich.

[21] Appl. No.: 09/017,614

[22] Filed: Feb. 2, 1998

[51] Int. Cl.[7] ..... F04B 23/00; F01C 1/30

[52] U.S. Cl. ..... 417/253; 417/310; 418/6

[58] Field of Search ..... 417/253, 252, 417/310; 418/1, 6, 11, 59, 13, 3

[56] References Cited

U.S. PATENT DOCUMENTS

| | | | |
|---|---|---|---|
| 862,867 | 8/1907 | Eggleston | 418/6 |
| 2,759,664 | 8/1956 | Auwarter | 230/152 |
| 2,820,415 | 1/1958 | Born | 103/37 |
| 3,402,891 | 9/1968 | Clark et al. | 239/127 |
| 3,680,980 | 8/1972 | Bart | 417/253 |
| 3,692,052 | 9/1972 | Cattanach | 137/561 |
| 4,061,443 | 12/1977 | Black et al. | 417/222 |
| 4,505,653 | 3/1985 | Roberts | 418/23 |
| 4,566,863 | 1/1986 | Goto et al. | 417/295 |
| 4,744,733 | 5/1988 | Terauchi et al. | 417/310 |
| 4,892,466 | 1/1990 | Taguchi et al. | 417/295 |
| 4,904,164 | 2/1990 | Mabe et al. | 417/308 |
| 4,976,592 | 12/1990 | Nakajima et al. | 417/295 |
| 5,015,161 | 5/1991 | Amin et al. | 418/6 |
| 5,074,760 | 12/1991 | Hirooka et al. | 417/310 |
| 5,074,761 | 12/1991 | Hirooka et al. | 417/310 |
| 5,201,189 | 4/1993 | Yokomachi et al. | 62/196.3 |
| 5,284,426 | 2/1994 | Strikis et al. | 418/6 |
| 5,399,076 | 3/1995 | Matsuda et al. | 418/6 |

FOREIGN PATENT DOCUMENTS

| | | |
|---|---|---|
| 565263 | 11/1944 | European Pat. Off. . |
| 3536714 | 10/1985 | Germany . |
| 59-77095 | 10/1982 | Japan . |
| 59-99089 | 11/1982 | Japan . |
| 62-81588 | 10/1985 | Japan . |
| 2-204694 | 8/1990 | Japan . |

*Primary Examiner*—Henry C. Yuen
*Assistant Examiner*—Mahmoud M. Gimie
*Attorney, Agent, or Firm*—Frank G. McKenzie

[57] ABSTRACT

A multiple stage rotary compressor having a housing with a pump cavity and an orbiting ring piston in the cavity. A cylindrical post carried by the housing within the orbiting ring. A pair of vanes engaging the outer surface of the orbiting ring to define first-stage having a pair of primary pumping chambers in the cavity. A second pair of internal vanes contacting the inner surface of the orbiting ring to define a second-stage having a pair of secondary pumping chambers. A capacity control mechanism applied to the first-stage operative to limit the compressor capacity to the second-stage only. A second capacity control mechanism applied to the second-stage operative to variably bypass second-stage discharge to second-stage suction. The plurality of capacity controllers operating to establish varying compressor pump capacity depending upon the operating requirements of the compressor.

5 Claims, 9 Drawing Sheets

1ST POS.
2ND POS.

88
200
204
206
202
208
210
206
118
142

FIG 7A
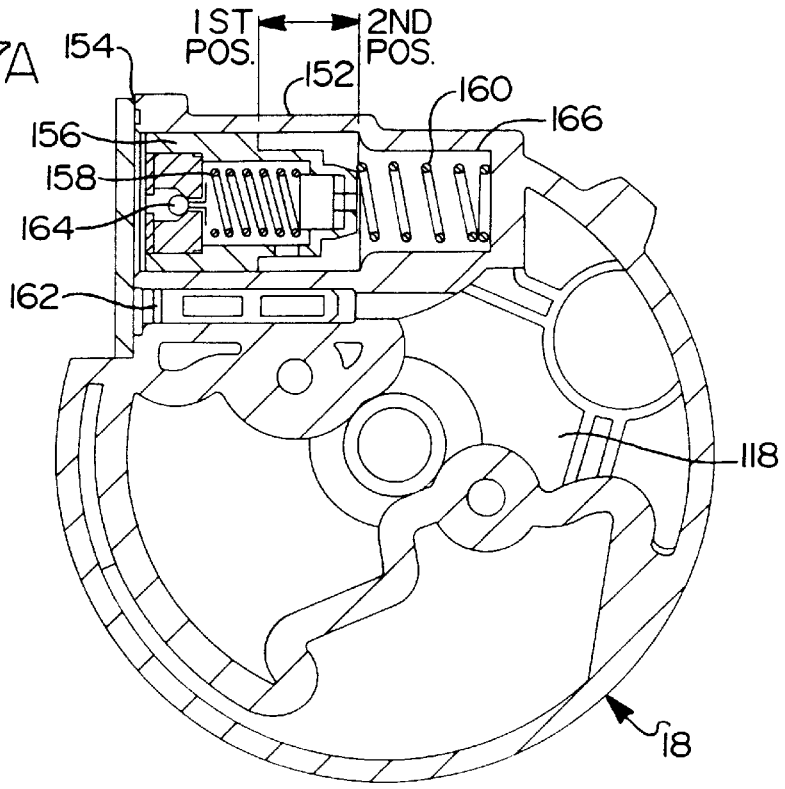
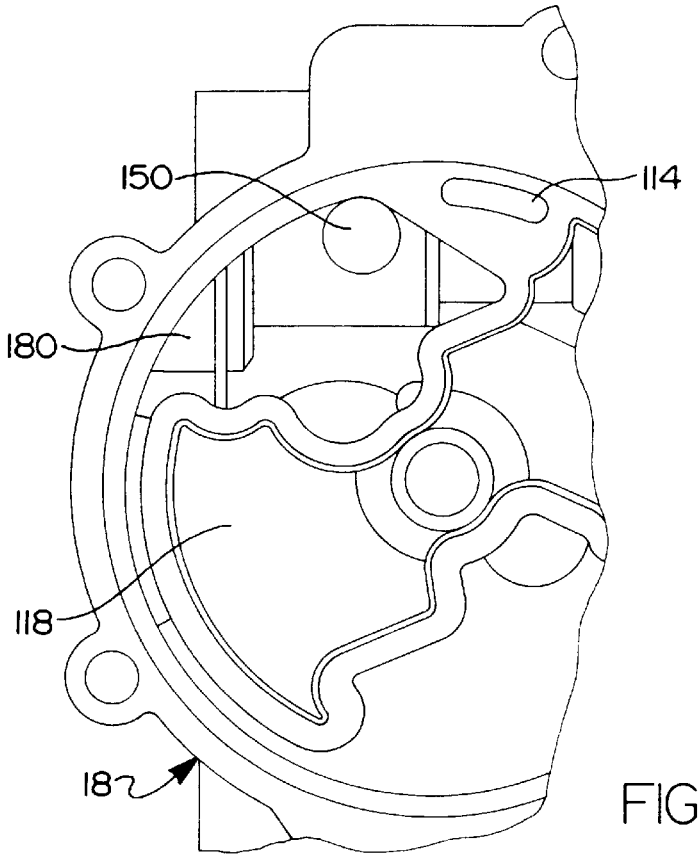
FIG 7B

MULTI-STAGE COMPRESSOR WITH CONTINUOUS CAPACITY CONTROL

BACKGROUND OF THE INVENTION

1. Field of the Invention

The instant invention relates to rotary compressors for automotive climate control systems. More particularly, the instant invention relates to a multi-stage rotary piston compressors having a plurality of valves to obtain continuous capacity control.

2. Description of the Related Art

When the air conditioning load in the passenger compartment of a vehicle is below a predetermined temperature, the displacement of a compressor within an air conditioning system of the vehicle can be decreased. This will result in a reduced compression ratio in the compressor and therefor a reduced cooling capacity.

It is known to vary the capacity of a compressor dependent upon operating requirements. An example of a compressor having capacity control is disclosed in U.S. Pat. No. 5,284,426, which is assigned to the assignee of the present invention. The '426 patent describes a refrigerant gas compressor having variable capacity control achieved by selectively disabling the outer vanes that cooperate with the outer perimeter of the orbiting ring piston. Either one or both of two outer vanes can be selectively disabled. However, the '426 patent decreases the compressor capacity in discrete steps.

It is also know to vary the capacity of a single stage compressor by valve means. An example of a single valve in a scroll type compressor is provided by Terauchio et al., U.S. Pat. No. 4,744,733. An example of such in a rotary type compressor is Goto et al., U.S. Pat. No. 4,566,863, which also teaches a single valve to open and close a by-pass passage.

However, neither Terauchio nor Goto provide the functional flexibility to match directly the compressor capacity with demand and neither teach how to do so with a compressor having multiple stages. The use of a single valve strictly limits the functional operating range of the capacity control. The limited functional range limits the decrease in parasitic loses and the overall horsepower savings of the air conditioning system. Further, the prior art compressors can only provide a restricted cycling map, in which it is necessary to cycle the compressor on/off with great frequency. The increased cycling frequency creates torque shock thereby increasing noise and vibration during compressor operation.

It is desirable to provide a multi-stage rotary piston compressor for automotive climate control systems which directly regulates compression volume in relation to demand. It is still further desirable to provide a multi-stage rotary piston compressor with a significantly increased cycling map.

SUMMARY OF THE INVENTION

Responsive to the disadvantages of the prior art, the instant invention provides improvements to a multi-stage orbiting ring piston compressor disclosed in U.S. Pat. No. 5,015,161, which is assigned to the assignee of the instant invention. The instant invention is characterized by a plurality of valves operative to directly regulate compression volume in relation to demand while providing a significantly increased cycling map.

According to a principal feature of the instant invention, the variable capacity control is achieved by a plurality of valves operating simultaneously in relation to a control pressure. Thus, it is not necessary to operate the compressor at maximum capacity when only partial load is demanded by the operating environment for the air conditioning system. Further, by providing a plurality of valves operating simultaneously in relation to a control pressure the instant invention provides a significantly increased cycling map, i.e., the variation of compressor pressure with time resulting from control valve operation. This provides nearly continuous operation in which it is unnecessary to cycle the compressor on/off. Therefore, parasitic losses associated with driving the compressor are minimized. The frequency of torque shock, noise and vibration during compressor operation are minimized also.

According to one embodiment of the instant invention a multi-stage rotary gas compressor for compressing a fluid is disclosed. The compressor housing defines a compression chamber having an inner surface with a first axis, a post substantially coaxial with respect to the compression chamber having an outer surface, and an orbital ring piston mounted for orbital movement about a second geometric axis, the orbital ring piston being offset relative to the first geometric axis. The outer surface of the orbital ring piston is adapted to contact said compression chamber inner surface, and an inner surface is adapted to contact the outer surface of the post.

The housing carries outer vanes, adapted to move into engagement with the orbital ring piston outer surface, and inner vanes, mounted on the post adapted to engage the orbital ring piston inner surface. The outer vanes cooperate with the orbital ring piston and the compression chamber to define a first-stage having first and second compression chamber portions. The inner vanes cooperate with the orbital ring piston and the post to define a second-stage having third and fourth compression chamber portions.

First-stage inlet ports and first-stage outlet ports are located within the housing and communicate with first and second compression chamber portions. Second-stage inlet ports and second-stage outlet ports are located in the housing and communicate with the third and fourth compression chamber portions.

An intermediate compression chamber is further located within the housing and connects the first-stage outlet ports with the second-stage inlet ports. A first-stage by-pass passage is formed through the housing between the intermediate compressor chamber and at least one of the first-stage inlet ports. A second-stage by-pass passage is formed through the housing between at least one second-stage outlet port and the intermediate compressor chamber.

A first-stage control valve means within the housing defines a first-stage control chamber and a valve set to operate at a predetermined first-stage control pressure, the valve being movable between a first position and a second position and biased towards the first position by a spring. The first position of the valve thereof at least partially opens the first-stage by-pass passage, and a second position thereof closes the first-stage by-pass passage.

A first first-stage communication channel formed through the housing between said first-stage inlet ports and the first control valve provides a first-stage suction pressure. A second first-stage communication channel is formed through the housing between the first-stage outlet ports and the first-stage control chamber. The first-stage communication channel provides a first-stage discharge pressure urging the first valve member towards the second position.

The first-stage valve member, shifts towards the first position when the first-stage suction pressure is equivalent to the first-stage control pressure, whereby the first-stage discharge pressure is insufficient to overcome the valve biasing spring.

A second-stage control valve means within said housing includes a valve member movable between a first position at least partially opening the second-stage by-pass passage and a second position closing the second-stage by-pass passage, the valve being biased towards the first position by a spring.

A first second-stage communication channel formed through the housing between the first-stage inlet ports and second-stage control valve means provides a first-stage suction pressure. The first-stage suction pressure urges the second-stage valve member towards the first position.

A second second-stage communication channel formed through the housing between the intermediate compression chamber and the second-stage valve provides an intermediate pressure urging the valve member towards the second position. The second-stage valve shifts towards the first position when the difference between the first-stage suction pressure and the intermediate pressure is insufficient to overcome the valve biasing spring.

In another embodiment of the instant invention, the second-stage valve means comprise an independent member for each second-stage compressor portion, each valve member and associated passages located within the compressor housing.

Accordingly, an object of the instant invention is to provide a multi-stage rotary piston compressor having continuous capacity control directly relating compressor capacity with demand.

An advantage of the instant invention is the use of a plurality of valves, which limit capacity in proportion to demand. A further advantage is operating the compressor in relation to a control pressure to provide a significantly increased cycling map.

These and other desired objects of the instant invention will become more apparent from the following detailed description and appended claims. The invention may best be understood with reference to the accompanying drawings wherein illustrative embodiments are shown.

BRIEF DESCRIPTION OF THE DRAWINGS

FIGS. 7*a* and 7*b* are end views of the rear head showing the first-stage control valve and associated fluid passages.

DETAILED DESCRIPTION OF THE PREFERRED EMBODIMENTS

Figure 1A:
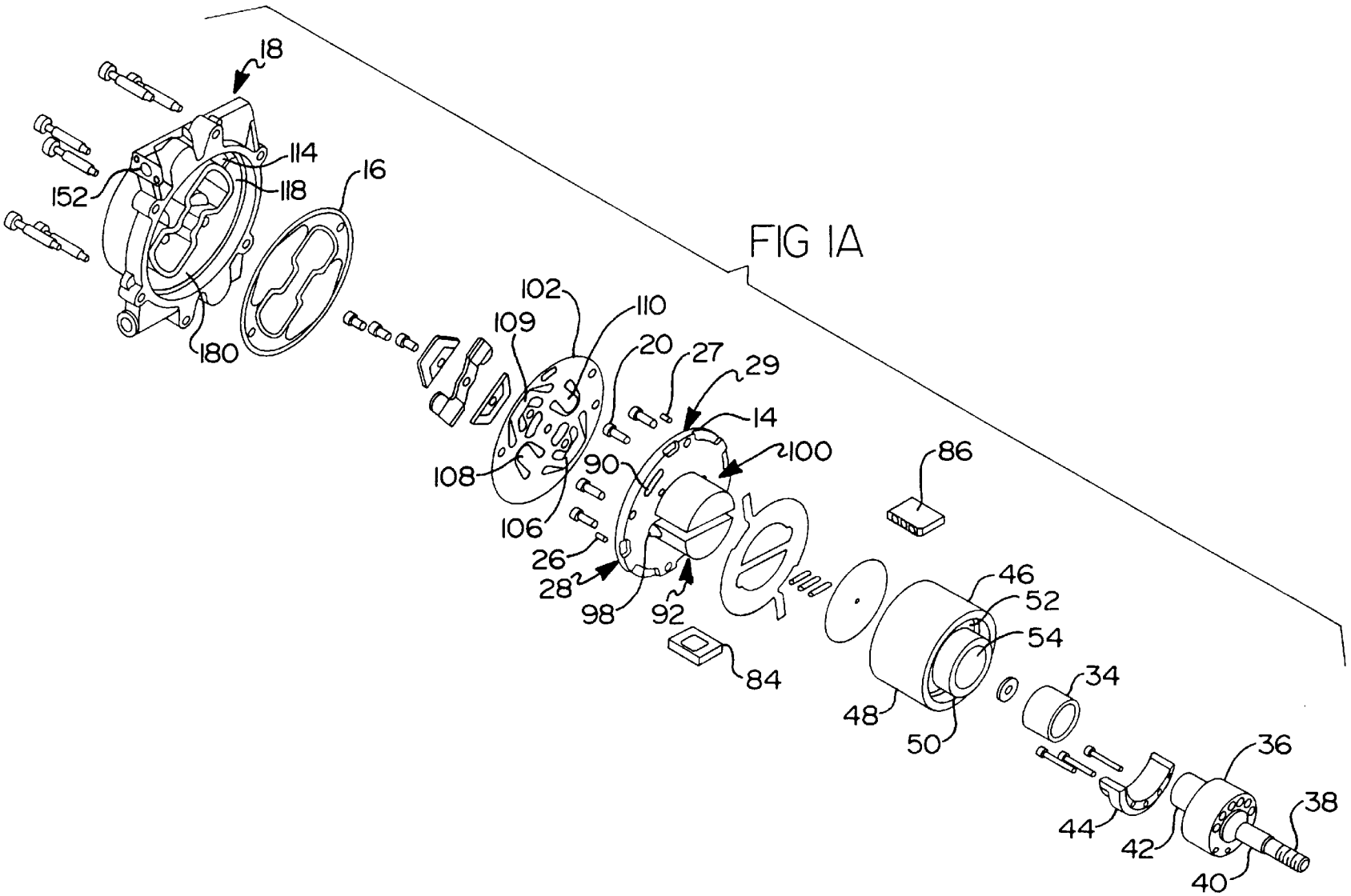
FIG. 1 is an isometric view showing components of the compressor displaced axially from one another and arranged generally in the order of assembly.
Figure 1B:
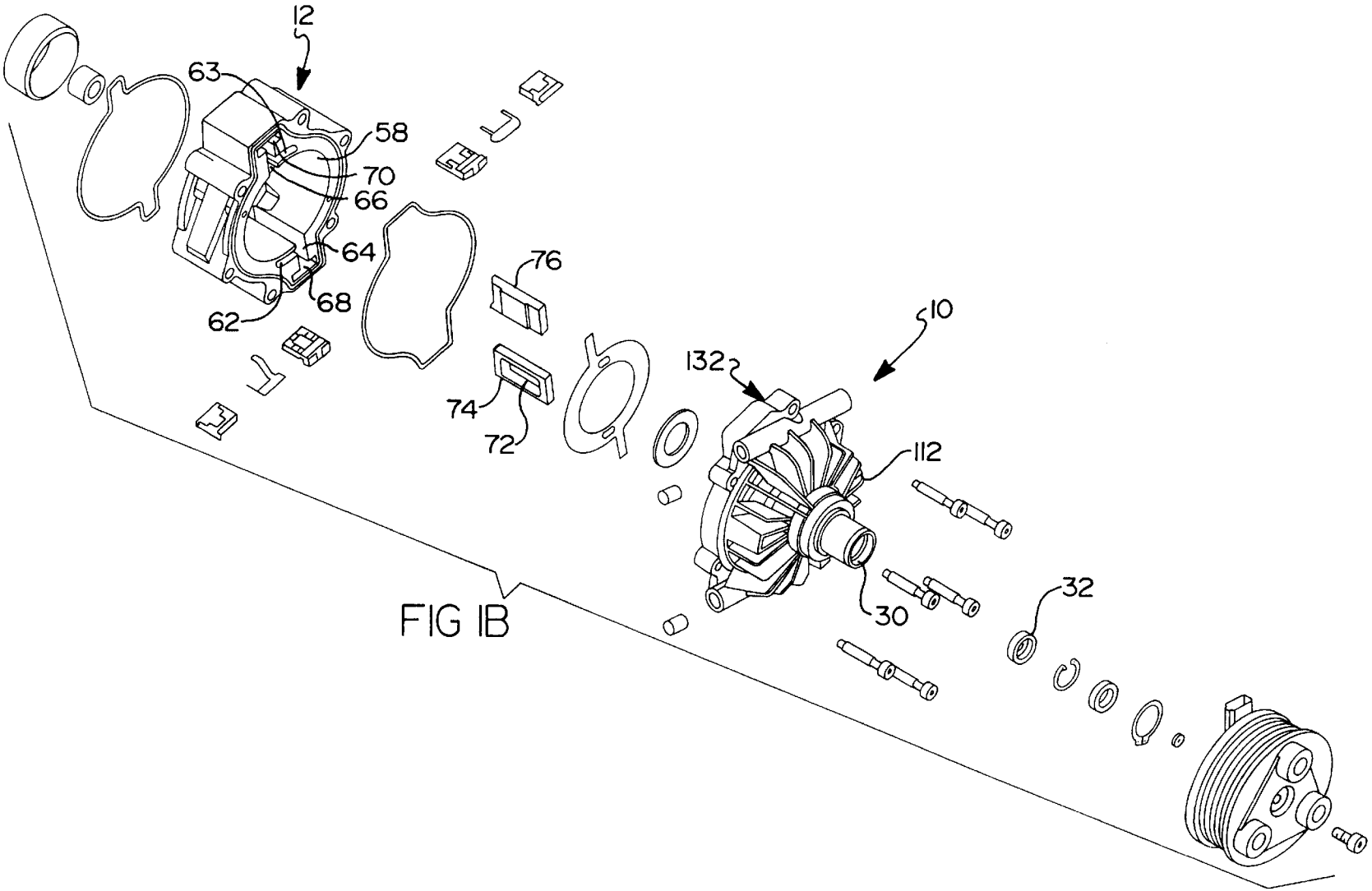

The instant invention will be described through a series of drawings, which illustrate the multi-stage rotary piston compressor having full capacity control of the instant invention. Referring first to FIG. 1, the housing of a gas compressor includes a front head 10, center housing 12, rear gasket 16 and rear head 18. These components and rear plate 14 are mutually connected by passing tension bolts 20 through four aligned bolt holes formed in engaging threads tapped in the center housing 12. Dowel pins 26, 27 located within holes 28, 29 in the rear face of the rear plate maintain alignment of the gasket.

The front head includes a cylindrical bore 30 having a small diameter sized to receive a hydraulic seal 32 and a larger diameter sized to receive roller bearing 34. The bearing rotatably supports a crankshaft 36, which includes a spline surface 38 for drivably connecting the crankshaft to the sheave of a drivebelt assembly.

Figure 2:
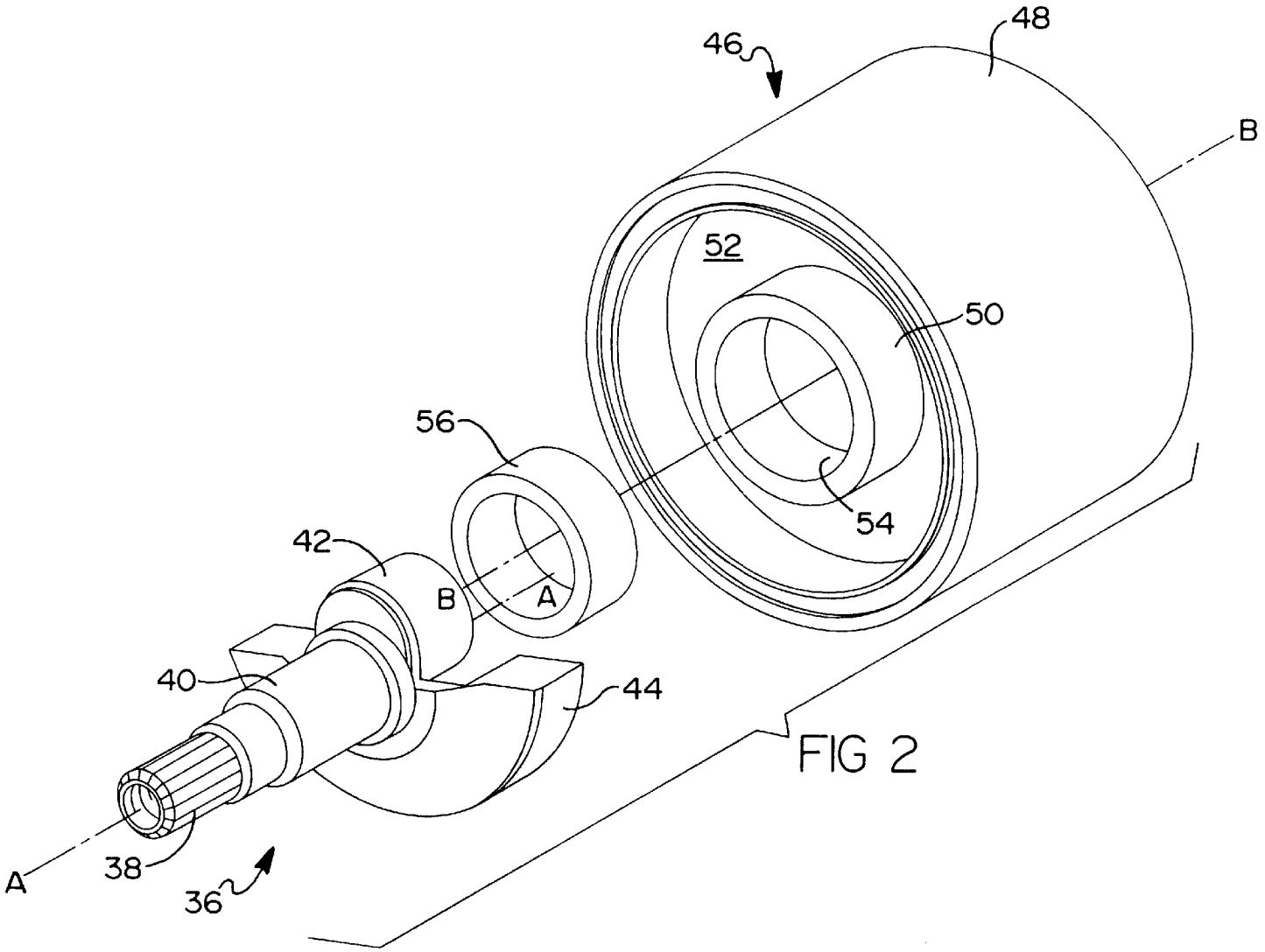
FIG. 2 is an isometric view showing the face of the orbiting ring, bushing and crankshaft.

Referring next to FIG. 2, a cylindrical shoulder 40 is fitted within the bearing concentrically with axis A—A, eccentric 42 has a cylindrical surface whose axis B—B is offset radially from axis A—A, and a large cylindrical surface 44 is coaxial with A—A. An orbiting ring 46 includes a cylindrical outer surface 48 coaxial with B—B, a cylindrical boss 50 joined by a web 52 to the outer surface defines a central bore 54 concentric with axis B—B. Bushing 56 is fitted within bore 54 and rotatably supports eccentric 42 on the orbiting ring.

FIG. 1 further shows a center housing 12 that includes a cylindrical inner surface 58 on which the outer cylindrical surface 48 of the orbiting ring rolls, a suction passage 62 through which incoming low pressure gas flows, and outer vane slots 64, 66 in which vanes 74,76, slide into contact with the outer surface of the orbiting ring 46. Inlet passages 68, 70, communicating respectively with passages 62, 63, carry refrigerant at suction pressure to inlet pocket 72, 73 formed on the lateral, inner faces of the outer vanes 74, 76, respectively.

A valve plate 102, formed of spring steel, seats within a circular recess formed on the rear face of plate 14 and defines four reed valves: first and second first-stage discharge valves 104, 106 for opening and closing passages 90, 92; and first and second second-stage discharge valves 108, 110 for opening and closing passages 98, 100.

Gasket 16, located between the adjacent faces of the rear head and center housing, seals intermediate and discharge plenums.

Figure 3:
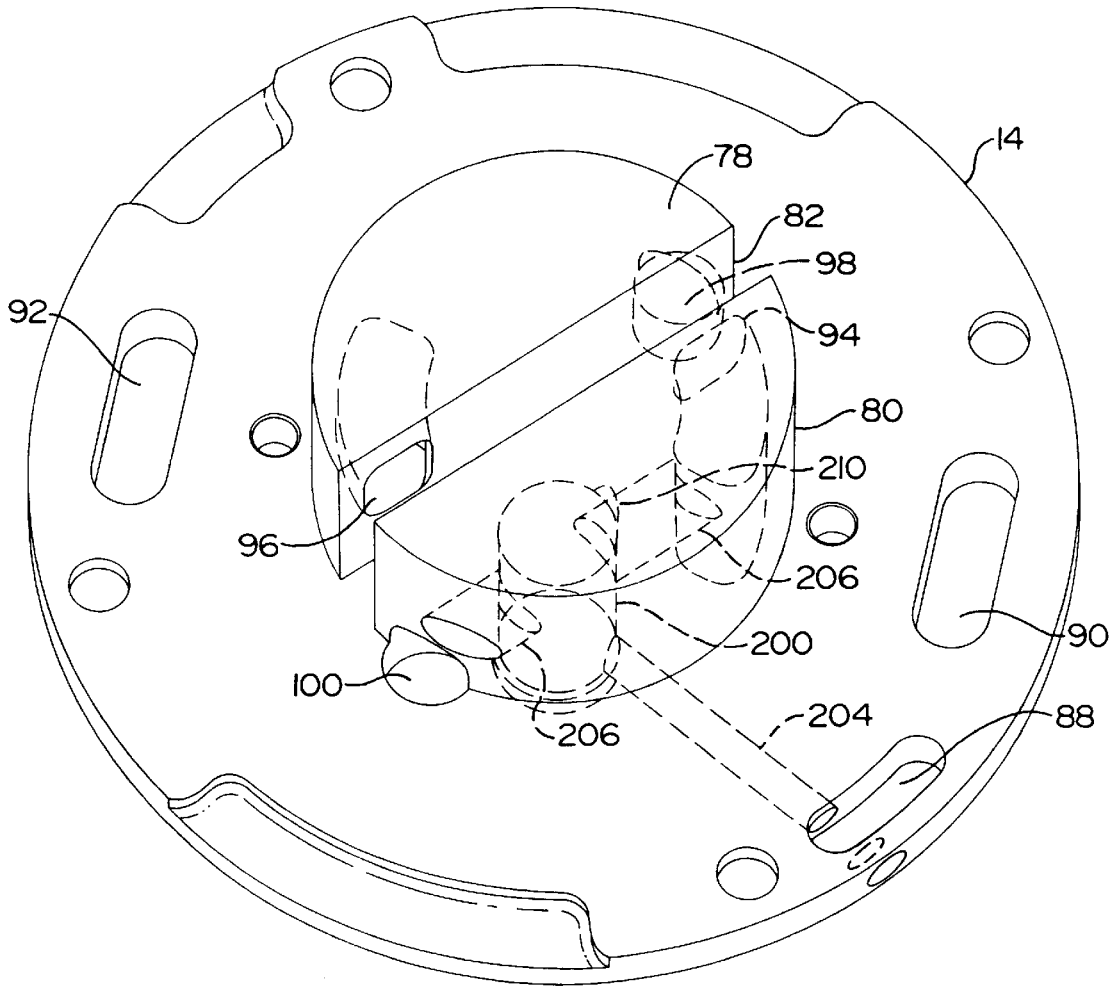
FIG. 3 is an isometric view showing the front face of the rear plate.
Figure 5:
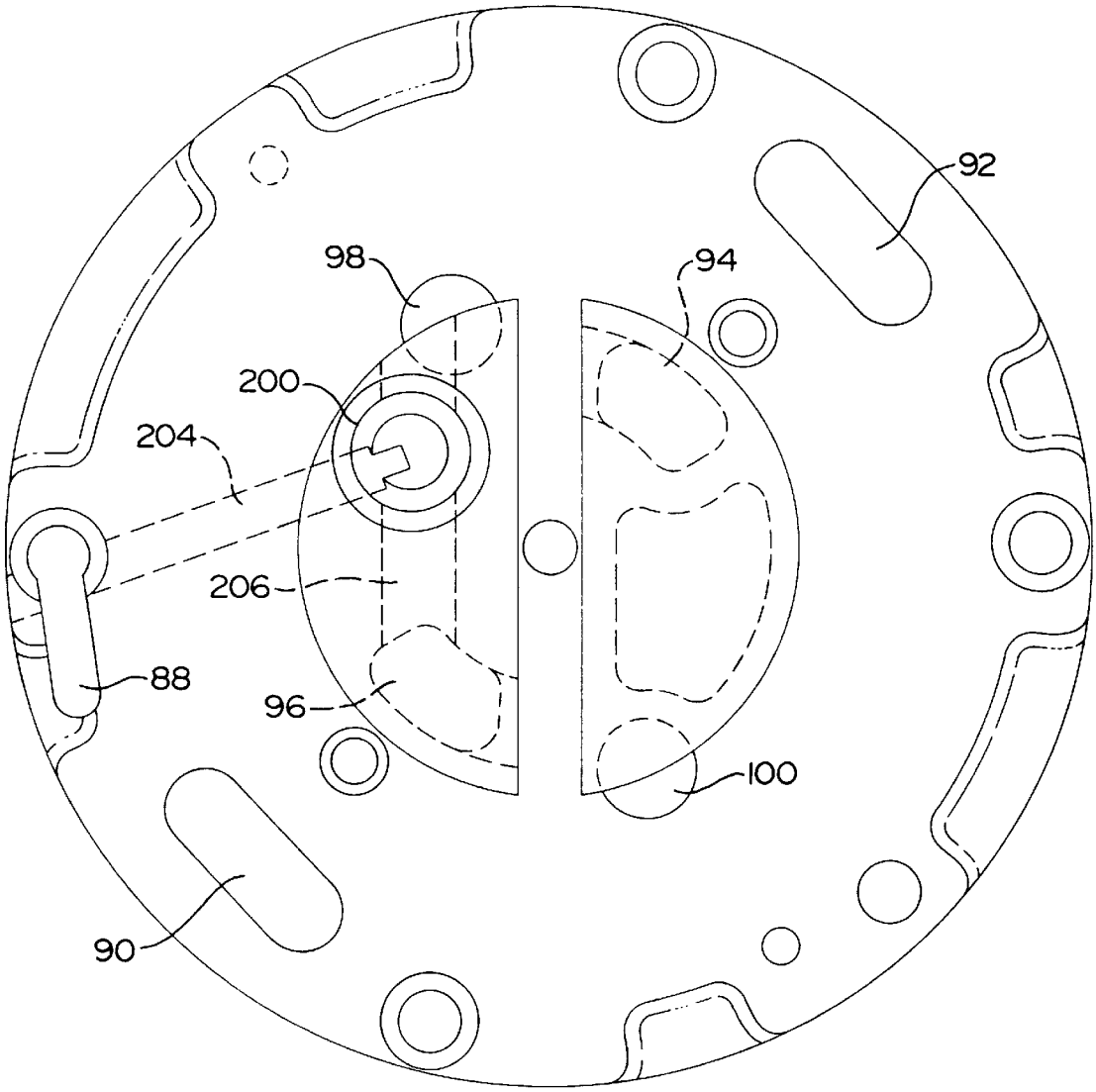
FIG. 5 is a front view showing the front face of the rear plate and the location of the fluid passages.

Referring now to FIGS. 1, 3 and 5, rear plate 14 includes a post 78 having an outer cylindrical surface 80 coaxial with axis A—A, sized to fit within the orbiting ring and located within center housing 12. The post 78 contains a transverse diametric slot 82, within which internal vanes 84, 86 are mounted for sliding radially outward directed movement into contact with the inner surface of the orbiting ring 46. The rear plate also includes a suction passage 88 aligned with passage 62, first-stage-discharge passages 90, 92, intermediate or second-stage inlet passages 94, 96, and second-stage discharge passages 98, 100.

The rear plate 14 further includes at least one second-stage control valve bore and at least one second-stage control valve 202 located in bore 200. A first second-stage control passage 204 is formed through the rear plate 14 between the first-stage suction pressure source 88 and the low pressure side of the second-stage control valve bore 200. A second second-stage control passage 210 formed through the rear plate 14 between intermediate compressor chamber 118, passage 206 and the high pressure side of the second-stage control valve bore 200.

Figure 6:
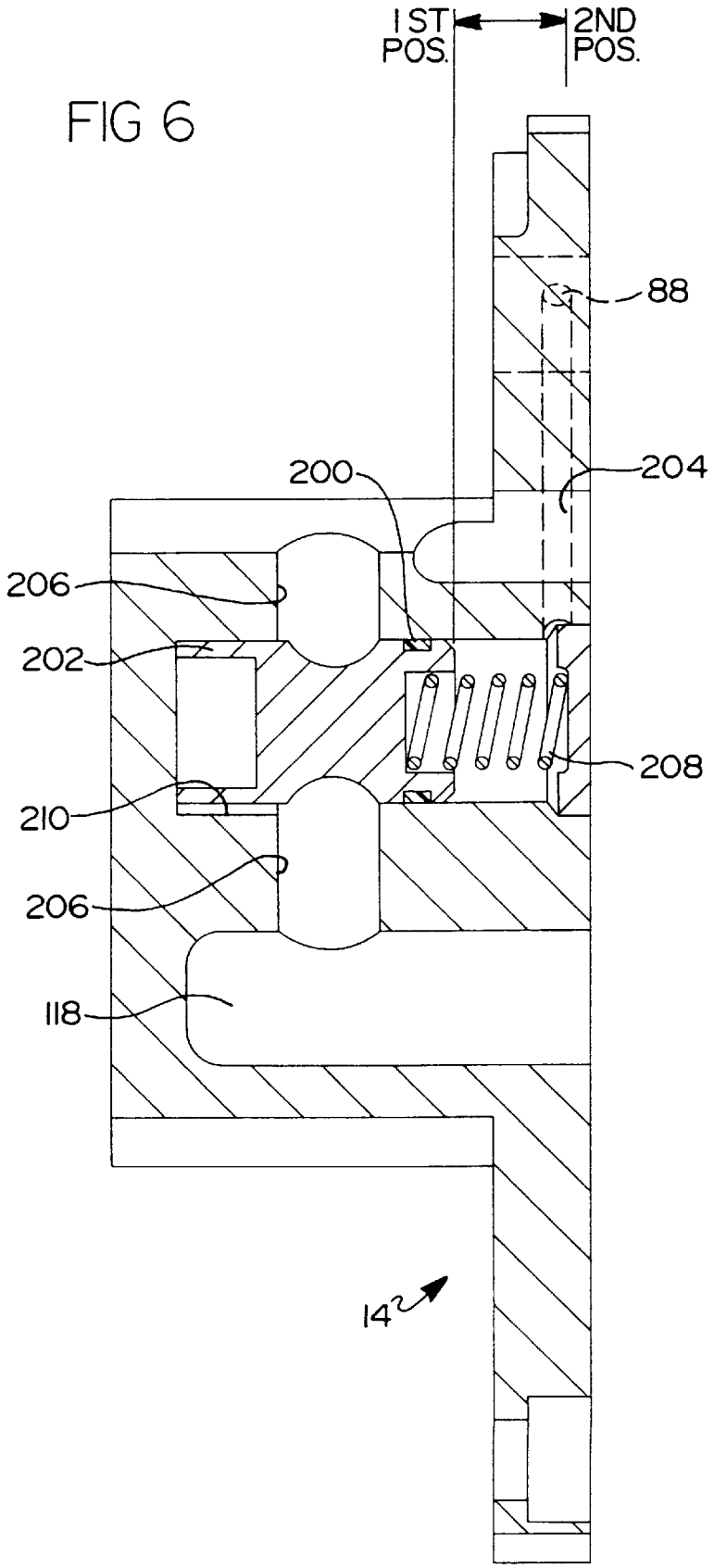
FIG. 6 is a cross section through the rear plate showing the second-stage control valve and associated fluid passages.

Referring to FIG. 6, the second-stage control valve 202 is movable between a first position thereof at least partially opening the second-stage by-pass passage 206 and a second position thereof closing the second-stage by-pass passage 206. Contained within the control valve bore 200 is a spring 208 biasing the second-stage control valve member 202 towards the first position. The first second-stage channel 204 carries first-stage suction pressure bore 200, also urging the second-stage control valve 202 towards its first position.

The second second-stage communication channel 210 carries intermediate pressure, i.e., pressure between the discharge side of the first stage and inlet side of the second stage, which urges the second-stage control valve 202 towards the second position at the lower end of bore 200. The second-stage control valve 202 shifts towards the first position when the net pressure force on the valve resulting from first-stage suction pressure and intermediate pressure is insufficient to overcome the biasing force of spring 208.

Referring again to FIG. 1, front head 10 includes a suction port 112, suction passage 132, aligned and communicating with suction passage 62,63.

Figure 4:
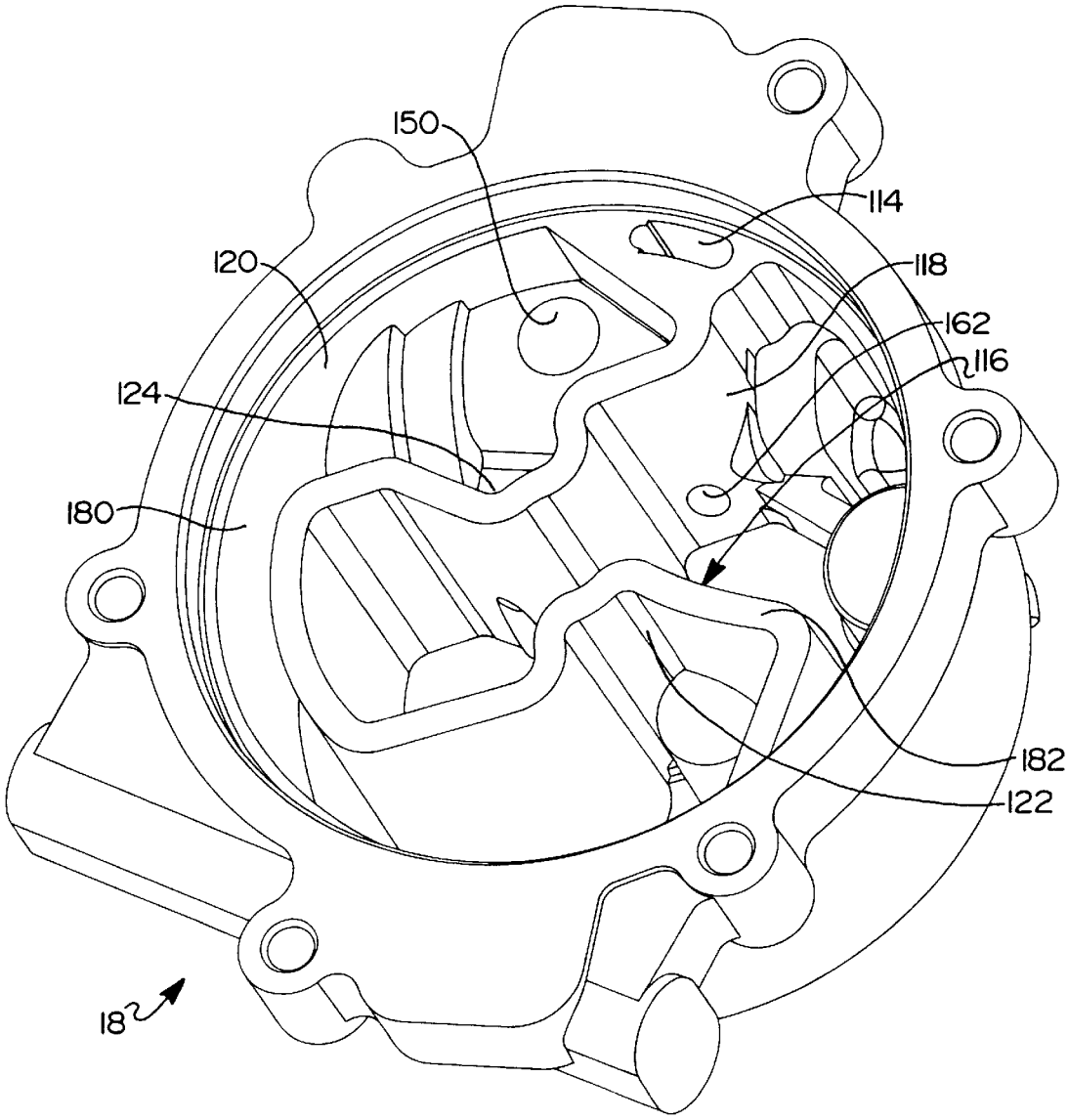
FIG. 4 is an isometric view showing the interior face of the rear head.

Referring to FIGS. 1 and 4, the discharge port, that connects the discharge side of the first stage and the intermediate pressure chamber 180 communicating with the interior of discharge pressure chamber 118 is integrally cast with the body of the rear head. Surrounding discharge pressure chamber 118, the walls of the rear head define a space, the intermediate pressure chamber 180, located within the inner surface 120 of the side walls of the rear head. Gas at first-stage discharge pressure flows through passages 122, 124 defined by the waist of intermediate chamber 118. Passages 122, 124 are aligned with intermediate pressure passages 94, 96 formed through the thickness of rear plate 14 and the length of post 78, through which gas compressed in the first-stage is carried to and enters the second stage.

Referring next to FIGS. 1, 4, 7*a* and 7*b*, rear head 18 further includes a first-stage by-pass passage 150 formed between the intermediate pressure chamber 180 and at least one of the first-stage suction passages 114. The first-stage valve bore 152 is located in rear head 18 and defines a high-side control chamber 154, a low-side control chamber 166, and contains the first-stage valve member 156 located therebetween. The high-side control chamber 154 directly communicates by a restricted flow orifice tube 162 to second-stage discharge. The low-side pressure communicates with first-stage suction and contains an internal bellows mechanism 158 that is operative to open the ball valve 164 in the first-stage control valve 156. The ball valve 164 allows communication between the high-side chamber 154 and the low-side chamber 166.

When the ball valve 164 is closed, full second-stage discharge pressure is achieved in the high-side chamber 154. The action of the pressure differential overcomes the force of spring 160 and maintains the first-stage valve member 156 in the second position, at the right-hand end of bore 152.

When the ball valve 164 begins to open, the pressure in the high-side chamber 154 reduces as the ball valve 164 opening is of a greater diameter than that of the orifice tube 162. The reduced pressure in the high-side chamber 154 is insufficient to overcome the force of spring 160 and the first-stage valve member 156 is urged toward the first position, at the left-hand extremity of bore 152.

The rear face of front head 10 defines an annular passage 132 located between the inner surface of its wall and the outer surface of journal 134, on which the crankshaft 40 is rotatably supported. Passage 132 connects suction passage 136, which communicates with suction passages 62, 88, 114, to first-stage inlet passage 138, which communicates with inlet passage 63 formed in the center housing. In this way, suction pressure is continually present in inlet passages 68, 70 and is communicated through the recesses or pockets 72, 73 formed on the surfaces of the outer vanes, through which gas at suction pressure is admitted to the first stage.

Details of the operation of a multi-stage compressor having fixed capacity control are disclosed in U.S. Pat. No. 5,015,16, which is incorporated herein by reference.

A multi-stage compressor having at least two valves provides mass flow according to the following equation:

$$M_{flow}=\rho_I \times V_{stage2} \times RPM - M_{recirculation}$$

where mass flow is equal to the intermediate pressure density $\rho_I$ multiplied by the volume of stage 2 $V_{stage2}$ multiplied by the speed of the compressor RPM, minus the mass recirculated valve flow $M_{recirculation}$. A representation of a cycling map for a multi-stage compressor having a plurality of valves is presented in FIG. 8.

Figure 8:
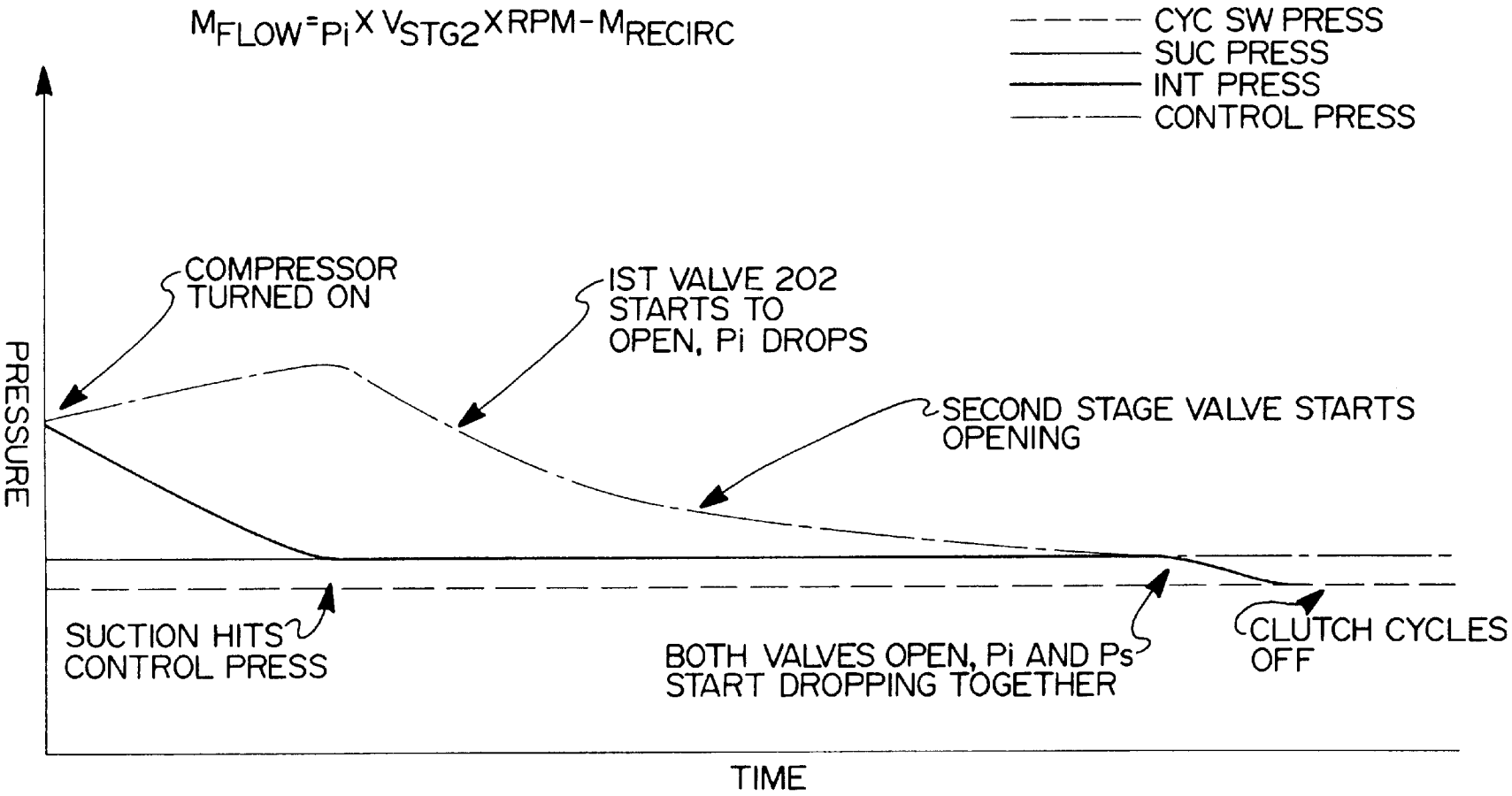
FIG. 8 is a representation of a cycling map for a multi-stage compressor of the instant invention.

FIG. 8 demonstrates that when the compressor output is greater than required, the output is reduced by opening the first-stage valve 156 to allow the intermediate pressure to bypass back to first-stage suction. When the first-stage valve 156 is fully open the intermediate pressure is equivalent to first-stage suction. The first-stage is thus effectively removed from the capacity of the compressor. Further reduction in compressive capacity is obtained by modulating the second-stage valve 202.

First-stage Valve Operation

While the compressor is operating at maximum capacity, the first-stage suction pressure is above the control pressure of the chamber that contains bellows 158 within the first-stage valve member 156. This control pressure is dependent upon the internal pressure of the bellows 158. Second-stage discharge pressure acts on the left hand side of the first-stage valve 156 and only first-stage suction pressure acts on its other side. At this point the first-stage biasing spring 160 is unable to actuate the bellows 158 and move the first-stage control valve 156 towards the first position. The fully closed first-stage valve 156 therefore prevents any bypass flow from the intermediate pressure chamber back to first-stage suction. The first-stage valve 156 remains fully closed as long as the first-stage suction pressure is greater than the control pressure.

When the first-stage suction pressure reaches equilibrium with the control pressure of the bellows 158 contained within the first-stage valve 156 the first-stage valve 156 begins to open a connection through first-stage bypass passage 150 between the intermediate pressure cavity 180 and first-stage suction 114. As the valve continues to open, flow of coolant from the first stage recirculation flow increases. As this flow increases the trend is for the intermediate pressure density to drop towards suction pressure. As can be seen in the equation above and in FIG. 8, the mass flow capacity drops linearly with intermediate pressure density.

Second-stage Valve Operation

Referring to FIG. 6, second-stage recirculation begins with full intermediate pressure acting on the upper end of the second-stage valve spool 202, first-stage suction pressure acting on the lower end of the spool while the force biasing spring 208 is unable to move the second-stage valve spool 202 towards the first position at the top of the valve chamber 200 where the valve partially opens passage 206 through the valve.

The second-stage valve spool 202 begins to modulate by more fully opening passage 206 when intermediate pressure rises relative to suction pressure in passage 204. The second-stage control pressure at which valve 202 modulates is determined by the force of spring 208 and the pressure difference across the valve member 202 times the pressure areas of the valve spool 202.

As intermediate pressure drops, the difference between the first-stage suction pressure and the intermediate pressure is insufficient to overcome the spring force. The second-stage valve member 202 then begins to shift towards the first position.

As the intermediate pressure and first-stage suction pressure obtain equilibrium, the biasing spring 208 is able to fully move the second-stage valve member 202 to the first position. Where compressive capacity is reduced to the maximum mass recirculation allowed by the valves.

In another embodiment of the instant invention a second valve is located in the second-stage to allow further reduction in compressive capacity. The second second-stage valve operates the same as the first second-stage valve and further extends the cycling map shown in FIG. 8.

Once the second-stage control valves have been fully opened and maximum mass recirculation is reached, the only way to further reduce compressor output is to further reduce suction pressure. This is again accomplished by switching the compressor off preferably by disengaging a clutch that connects and releases the compressor and a power source. Finally, as the pressure requirement rises to the cycling on pressure, the compressor is reconnected to the power source and the cycle map begins again.

It is thus seen that the objects of this invention have been fully and effectively accomplished. It will be realized, however, that the foregoing preferred embodiments have been shown and described for the purpose of illustrating the functional and structural principles of this invention and are subject to change and modification by those skilled in the art without departing from the principles described. Therefore, this invention includes all modifications encompassed within the spirit and scope of the following claims:

What is claimed is:

1. A multi stage rotary gas compressor for compressing a fluid comprising:

a compressor housing defining a compression chamber having a first-stage compression chamber portion having an input and output, and a second-stage compression chamber portion having an input and output;

means for compressing fluid in said first-stage compression chamber portion and said second-stage compression chamber portion;

a first passage for carrying fluid to and from said first-stage compression chamber portion;

a second passage for carrying fluid to and from said second-stage compression chamber portion;

an intermediate compression chamber connecting said second-stage compression chamber portion and said first-stage compression chamber portion;

first control valve means within said compressor housing for recirculating fluid from said intermediate compression chamber to said first-stage input; and second control valve means within said compressor housing for recirculating fluid from said second-stage output to said intermediate compression chamber.

2. A multi stage rotary gas compressor for compressing a fluid comprising:

a compressor housing defining a compression chamber, said chamber having an inner surface with a first geometric axis;

a post substantially coaxial with respect to said compression chamber and having an outer surface;

an orbital ring piston mounted for orbital movement about a second geometric axis that is offset relative to said first geometric axis, said orbital ring piston having an outer surface adapted to contact said compression chamber inner surface and an inner surface adapted to contact said outer surface of said post;

outer vanes carried by said housing and adapted to move into engagement with said orbital ring piston outer surface;

inner vanes mounted on said post adapted to engage said orbital ring piston inner surface;

said outer vanes cooperating with said orbital ring piston and said compression chamber to define a first-stage, said first-stage having first and second compression chamber portions, said inner vanes cooperating with said orbital ring piston and said post to define a second stage, said second-stage having third and fourth compression chamber portions;

first-stage inlet ports and first-stage outlet ports in said housing communication with said first and second compression chamber portions;

second-stage inlet ports and second-stage outlet ports in said housing communicating with said third and fourth compression chamber portions;

an intermediate compression chamber connecting said first-stage outlet ports and said second-stage inlet ports;

a first control valve means within said housing having a first-stage control chamber and a valve member defining a first-stage control pressure for recirculating fluid from said intermediate compression chamber to said first-stage input ports; and a second control valve means within said housing including a valve member for recirculating fluid from said second-stage outlet ports to said intermediate compression chamber.

3. A multi stage rotary gas compressor for compressing a fluid comprising:

a compressor housing defining a compression chamber, said compression chamber having an inner surface with a first geometric axis;

a post substantially coaxial with respect to said compression chamber and having an outer surface;

an orbital ring piston mounted for orbital movement about a second geometric axis that is offset relative to said first geometric axis, said orbital ring piston having an outer surface adapted to contact said compression chamber inner surface and an inner surface adapted to contact said outer surface of said post;

outer vanes carried by said housing and adapted to move into engagement with said orbital ring piston outer surface;

inner vanes mounted on said post adapted to engage said orbital ring piston inner surface;

said outer vanes cooperating with said orbital ring piston and said compression chamber to define a first-stage, said first-stage having first and second compression chamber portions, said inner vanes cooperating with said orbital ring piston and said post to define a second stage, said second-stage having third and fourth compression chamber portions;

first-stage inlet ports and first-stage outlet ports in said housing communicating with said first and second compression chamber portions;

second-stage inlet ports and second-stage outlet ports in said housing communicating with said third and fourth compression chamber portions;

an intermediate compression chamber in said housing connecting said first-stage outlet ports and said second-stage inlet ports;

a first-stage by-pass passage formed through said housing between said intermediate compressor chamber and at least one of said first-stage inlet ports;

a first control valve means within said housing having a first-stage control chamber and a valve member defining a first-stage control pressure, said valve movable between a first position thereof at least partially opening said first-stage by-pass passage and a second position thereof closing said first-stage by-pass passage, and means biasing said valve member towards said first position;

a first first-stage communication channel formed through said housing between said first-stage inlet ports and said first control valve providing a first-stage suction pressure;

a second first-stage communication channel formed through said housing between said first-stage outlet ports and said first-stage control chamber, said first-stage communication channel providing a first-stage discharge pressure, said first-stage discharge pressure urging said first valve member towards said second position;

said first valve member shifting towards said first position when said first-stage suction pressure and said first-stage control pressure are equivalent whereby said first-stage discharge pressure is insufficient to overcome said valve member biasing means;

a second-stage by-pass passage formed through said housing between said second-stage outlet ports and said intermediate compressor chamber;

a second control valve means within said housing including a valve member movable between a first position thereof at least partially opening said second-stage by-pass passage and a second position thereof closing said second-stage by-pass passage, and means biasing said valve member towards said first position;

a first second-stage communication channel formed through said housing between said first-stage inlet ports and said second control valve means for providing a first-stage suction pressure, said first-stage suction pressure urging said valve member towards said first position;

a second second-stage communication channel formed through said housing between said intermediate compression chamber and said second control valve means for providing an intermediate pressure, said intermediate pressure urging said valve member towards said second position; and said second valve member shifting towards said first position when the difference between said first-stage suction pressure and said intermediate pressure being insufficient to overcome said valve member biasing means.

4. The multi stage rotary gas compressor of claim 3 wherein said second first-stage communication channel being defined by a diameter, said diameter determining said second-stage control pressure.

5. The multi stage rotary gas compressor of claim 3 wherein said second valve member biasing means further comprising a spring having a spring constant said spring constant determining said second valve means shifting towards its said first position.

* * * * *